US009874851B2

(12) United States Patent
Watatani

(10) Patent No.: US 9,874,851 B2
(45) Date of Patent: Jan. 23, 2018

(54) IMAGE FORMING APPARATUS

(71) Applicant: KYOCERA Document Solutions Inc., Osaka (JP)

(72) Inventor: Tomohiro Watatani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 15 days.

(21) Appl. No.: 15/178,663

(22) Filed: Jun. 10, 2016

(65) Prior Publication Data

US 2016/0370755 A1 Dec. 22, 2016

(30) Foreign Application Priority Data

Jun. 18, 2015 (JP) ..... 2015-122830

(51) Int. Cl.
*G03G 15/16* (2006.01)
*G03G 21/16* (2006.01)
*G03G 15/20* (2006.01)

(52) U.S. Cl.
CPC ..... *G03G 21/1647* (2013.01); *G03G 15/2017* (2013.01); *G03G 21/1685* (2013.01)

(58) Field of Classification Search
CPC ..... G02F 1/0102; G02F 1/0121; G02F 1/19; G03G 15/2053; G03G 15/2017; G03G 15/2025; G03G 15/6552; G03G 21/1609; G03G 21/1619; G03G 21/1652; G03G 21/1695; G03G 2215/2032; G03G 2215/2035
See application file for complete search history.

(56) References Cited

U.S. PATENT DOCUMENTS

2008/0292345 A1* 11/2008 Kang ..... G03G 15/2035 399/67

FOREIGN PATENT DOCUMENTS

JP 2009-251309 A 10/2009

* cited by examiner

*Primary Examiner* — Roy Y Yi
(74) *Attorney, Agent, or Firm* — Studebaker & Brackett PC

(57) ABSTRACT

An image forming apparatus includes an apparatus main body, a fixing device, and a latching member. The fixing device is disposed in the apparatus main body. The latching member is disposed at the apparatus main body. The fixing device includes a fixing device main body and a fixing device cover. The fixing device cover is disposed over the fixing device main body in an openable and closable manner. The fixing device cover includes a fixing device cover main body and a to-be-latched portion. The fixing device cover is disposed over the fixing device main body in an openable and closable manner. The to-be-latched portion is disposed at the fixing device cover main body. In a situation in which the fixing device cover is opened, the to-be-latched portion is latched by the latching member.

7 Claims, 18 Drawing Sheets

IMAGE FORMING APPARATUS

INCORPORATION BY REFERENCE

The present application claims priority under 35 U.S.C. § 119 to Japanese Patent Application No. 2015-122830, filed on Jun. 18, 2015. The contents of this application are incorporated herein by reference in their entirety.

BACKGROUND

The present disclosure relates to an image forming apparatus.

An image forming apparatus forms an image on a sheet with toner. The image forming apparatus include a fixing device. The fixing device fixes a toner image to the sheet. A fixing device such as above is known. A fixing device such as above includes a fixing device main body and a fixing device cover. The fixing device cover includes a first cover portion and a second cover portion. The first cover portion opens and closes a rear surface of the fixing device main body. The second cover portion opens and closes an upper surface of the fixing device main body. The first cover portion has a lower end part pivotally supported on the rear surface of the fixing device main body. The second cover portion extends perpendicularly to the first cover portion from an upper edge of the first cover portion. When the fixing device cover is turned, the rear and upper surfaces of the fixing device main body are opened. In the above configuration, a jam in the fixing device main body can be cleared. Jam clearance is an operation to remove a jammed sheet.

SUMMARY

An image forming apparatus according to the present disclosure includes an apparatus main body, a fixing device, and a latching member. The fixing device is disposed in the apparatus main body. The latching member is disposed at the apparatus main body. The fixing device includes a fixing device main body and a fixing device cover. The fixing device main body fixes a toner image formed on a recording medium to the recording medium. The fixing device cover is disposed over the fixing device main body in an openable and closable manner. The fixing device cover includes a fixing device cover main body and a to-be-latched portion. The fixing device cover main body is disposed over the fixing device main body in an openable and closable manner. The to-be-latched portion is disposed at the fixing device cover main body. In a situation in which the fixing device cover is opened, the to-be-latched portion is latched by the latching member.

DETAILED DESCRIPTION

Figure 1:
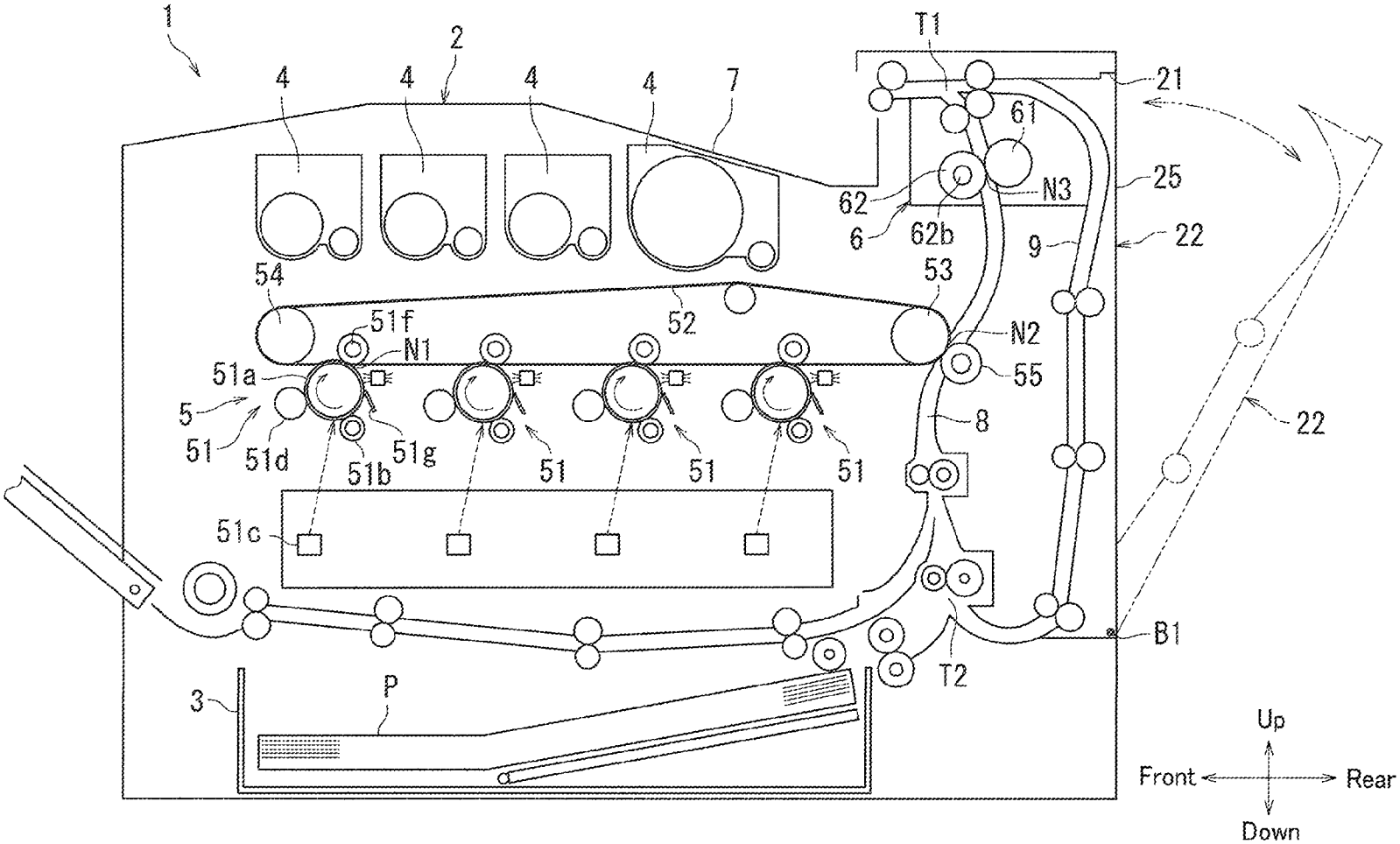
FIG. 1 illustrates a configuration of an image forming apparatus according to an embodiment of the present disclosure.

Following describes an embodiment of the present disclosure with reference to the accompanying drawings. Note that elements that are the same or equivalent are indicated by the same reference signs in the drawings and explanation thereof is not repeated.

An image forming apparatus according to the embodiment of the present disclosure will be described with reference to FIG. 1. FIG. 1 illustrates a configuration of an image forming apparatus according to the embodiment of the present disclosure.

As illustrated in FIG. 1, an image forming apparatus 1 according to the embodiment of the present disclosure forms a toner image on a sheet P (recording medium). As a result, an image is formed on the sheet P. The image forming apparatus 1 includes a casing 2 (apparatus main body), a sheet feed cassette 3, a plurality of toner containers 4, an image forming section 5, a fixing section 6 (fixing device), an exit tray 7, a sheet conveyance path 8, and a reversed sheet conveyance path 9.

The casing 2 accommodates respective elements of the image forming apparatus 1 (i.e., the sheet feed cassette 3, the toner containers 4, the image forming section 5, the fixing section 6, the sheet conveyance path 8, and the reversed sheet conveyance path 9).

The sheet feed cassette 3 supplies a sheet P to the image forming section 5. Plural sheets P are stacked and loaded in the sheet feed cassette 3. The sheets P in the sheet feed cassette 3 are fed one at a time and supplied to the image forming section 5 through the sheet conveyance path 8.

The toner containers 4 each are a container of a color toner (for example, a cyan toner, a magenta toner, a yellow toner, or a black toner). The toner containers 4 supply the respective color toners to the image forming section 5.

The image forming section 5 forms an image on the sheet P supplied from the sheet feed cassette 3 with the color toners supplied from the respective toner containers 4. The image forming section 5 includes a plurality of image forming units 51, an intermediate transfer belt 52, a drive roller 53, a driven roller 54, and a secondary transfer roller 55.

The image forming units 51 are each provided for corresponding one of the toner containers 4. The image forming units 51 receive supply of the corresponding toners from the corresponding toner containers 4. The image forming units 51 form toner images in the respective colors on a surface of the intermediate transfer belt 52 based on image information. The toner images in the respective colors are superimposed. Through the above, a full color toner image is formed on the surface of the intermediate transfer belt 52.

The image forming units 51 each include a photosensitive drum 51*a*, a charger 51*b*, an exposure device 51*c*, a developing device 51*d*, a primary transfer roller 51*f*, and a cleaner 51*g*.

The photosensitive drum 51*a* includes a photosensitive layer on a surface thereof. The charger 51*b* uniformly charges the surface of the photosensitive drum 51*a* to a specific potential. The exposure device 51*c* irradiates the charged surface of the photosensitive drum 51*a* with laser light. Through irradiation, the exposure device 51*c* forms an electrostatic latent image corresponding to the image information on the surface of the photosensitive drum 51*a*. The developing device 51*d* develops the electrostatic latent image on the surface of the photosensitive drum 51*a* into a toner image with toner supplied from a corresponding one of the toner containers 4.

The primary transfer roller 51*f* transfers the toner image on the surface of the photosensitive drum 51*a* to the surface of the intermediate transfer belt 52. The primary transfer roller 51*f* forms a primary transfer nip region N1 in cooperation with the photosensitive drum 51*a* with the intermediate transfer belt 52 therebetween. Primary transfer voltage is applied to the surface of the primary transfer roller 51*f*. In the above configuration, as the toner image on the surface of the photosensitive drum 51*a* passes through the primary transfer nip region N1, the toner image is transferred to the intermediate transfer belt 52 by electrostatic attraction of the primary transfer roller 51*f*. The cleaner 51*g* removes residual toner on the surface of the photosensitive drum 51*a* after transfer.

The intermediate transfer belt 52 conveys the color toner image on the surface thereof to the secondary transfer roller 55. The intermediate transfer belt 52 is an endless belt. The intermediate transfer belt 52 is wound between the drive roller 53 and the driven roller 54. The intermediate transfer belt 52 is circulated through rotational drive by the drive roller 53. Through circulation of the intermediate transfer belt 52, the toner image on the surface of the intermediate transfer belt 52 is conveyed to the secondary transfer roller 55.

The secondary transfer roller 55 transfers the toner image on the surface of the intermediate transfer belt 52 to the sheet P. The secondary transfer roller 55 forms a secondary transfer nip region N2 in cooperation with the drive roller 53 with the intermediate transfer belt 52 therebetween. Secondary transfer voltage is applied to the secondary transfer roller 55. In the above configuration, as the color toner image on the surface of the intermediate transfer belt 52 passes through the secondary transfer nip region N2 together with the sheet P, the toner image is transferred to the sheet P by the electrostatic attraction of the secondary transfer roller 55. The sheet P to which the toner image has been transferred is conveyed to the fixing section 6 through the sheet conveyance path 8.

The fixing section 6 fixes to the sheet P the toner image transferred to the sheet P. The fixing section 6 includes a pressure roller 61 and a fixing roller 62. The fixing roller 62 includes a heat source 62*b*. The heat source 62*b* applies heat to the sheet P. A fixing nip region N3 is formed between the pressure roller 61 and the fixing roller 62. As the sheet P to which the toner image has been transferred passes through the fixing nip region N3, the toner image is fixed to the sheet P though pressure by the pressure roller 61 and heat by the fixing roller 62. The sheet P to which the toner image has been fixed is ejected onto the exit tray 7.

The exit tray 7 is located on top of the casing 2, for example.

The sheet conveyance path 8 extends from the sheet feed cassette 3 to the exit tray 7 via the secondary transfer nip region N2 and the fixing nip region N3 in the stated order. The reversed sheet conveyance path 9 reverses sides of the sheet P having the fixed image on one of the sides and conveys the sheet P to the image forming section 5. The reversed sheet conveyance path 9 connects a diverging point T1 to a diverging point T2. The diverging point T1 is located downstream of the fixing section 6 in terms of a sheet conveyance direction in the sheet conveyance path 8. The diverging point T2 is located upstream of the image forming section 5 in terms of the sheet conveyance direction in the sheet conveyance path 8.

Figure 2:
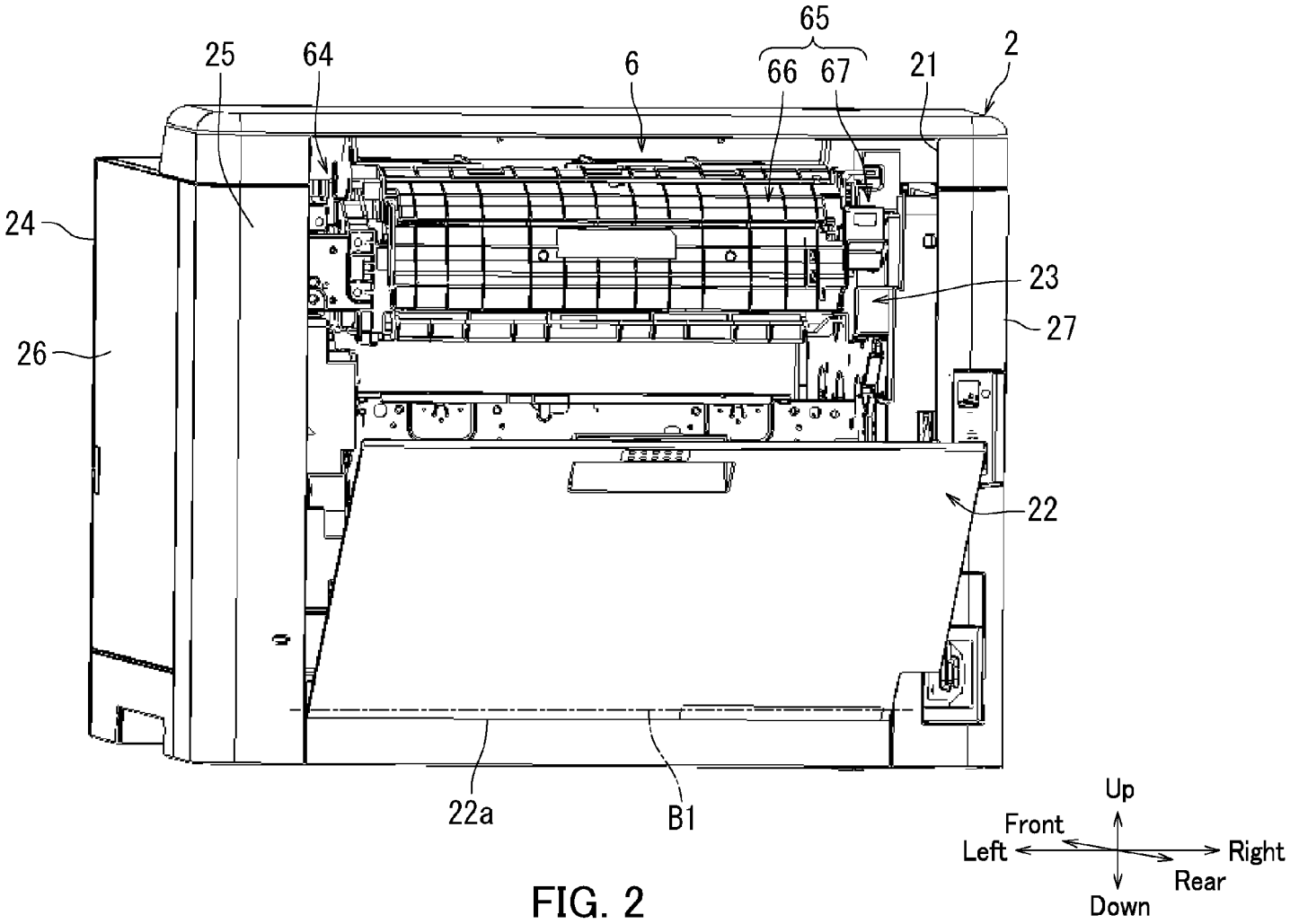
FIG. 2 is a perspective view illustrating a casing in a situation in which a rear cover is opened.
Figure 3:
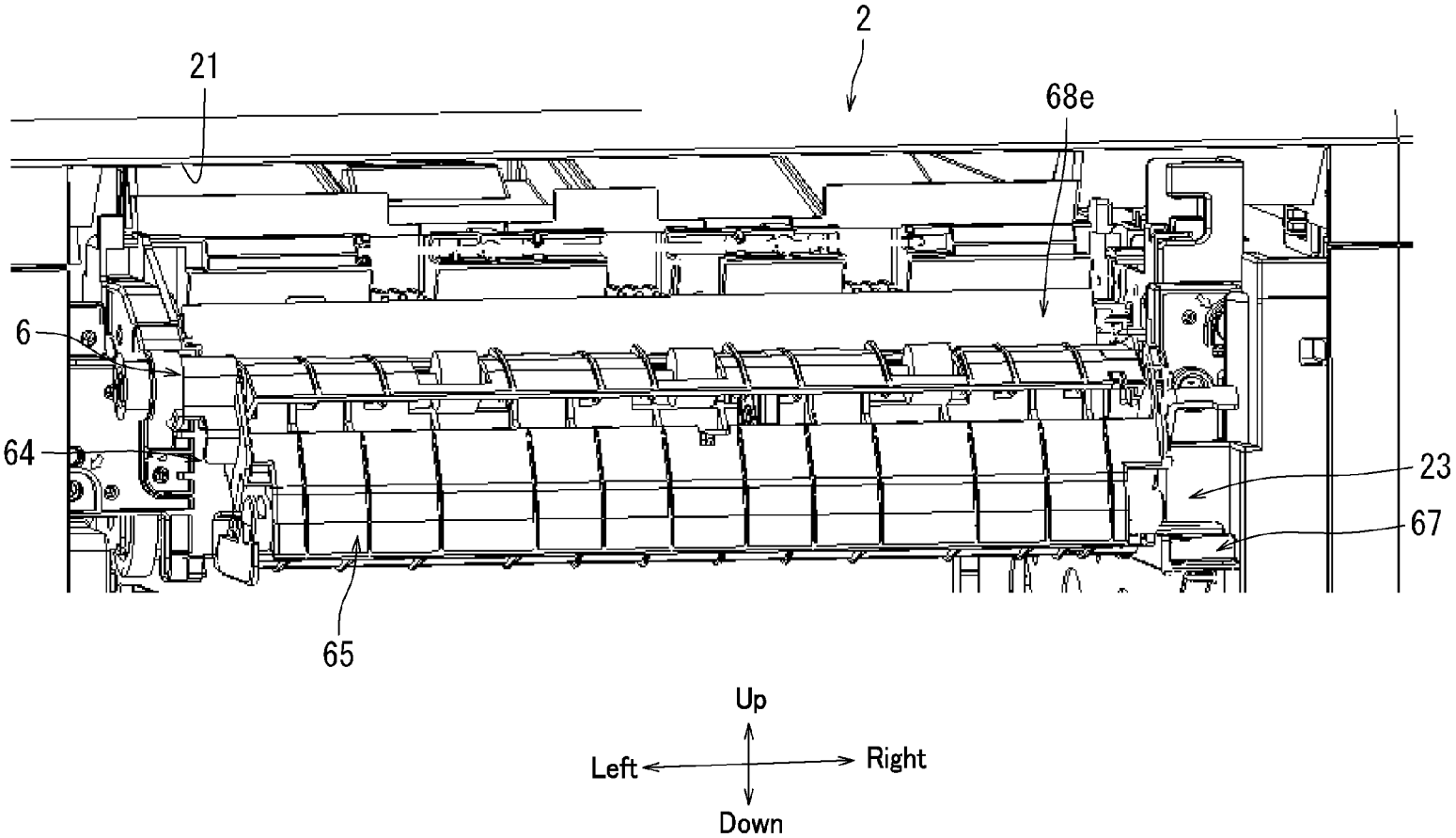
FIG. 3 is an enlarged partial view of the casing and illustrates a fixing section in a situation in which a fixing section cover is open.
Figure 4:
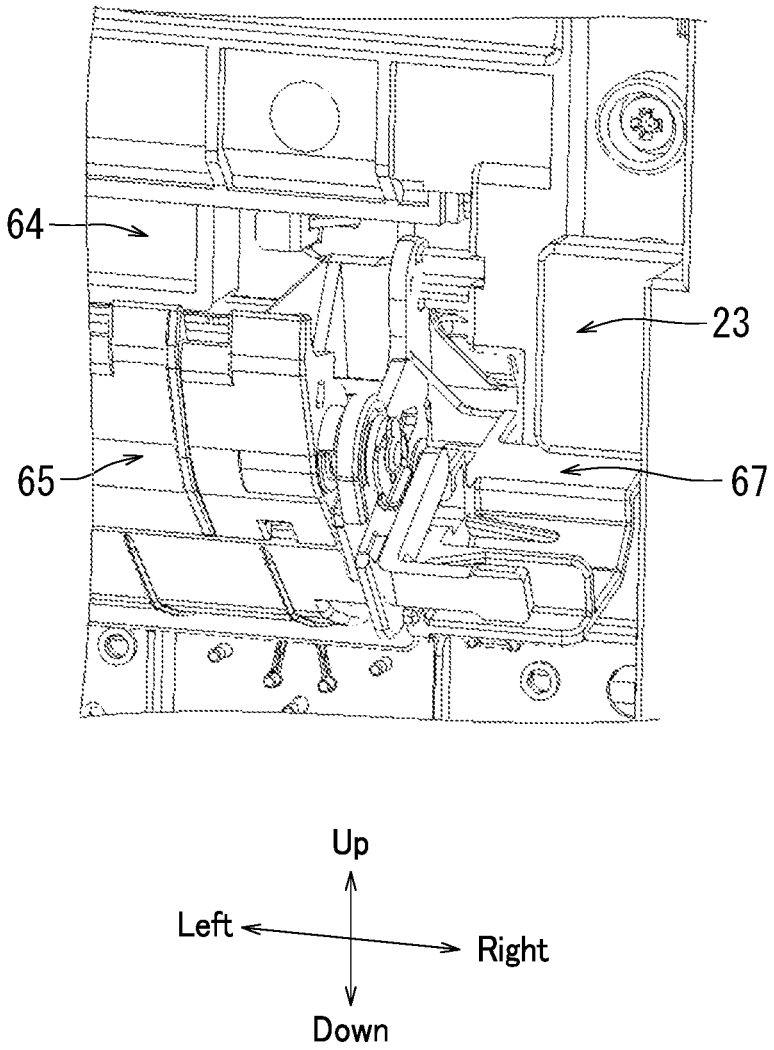
FIG. 4 is an enlarged partial view of FIG. 3.
Figure 5:
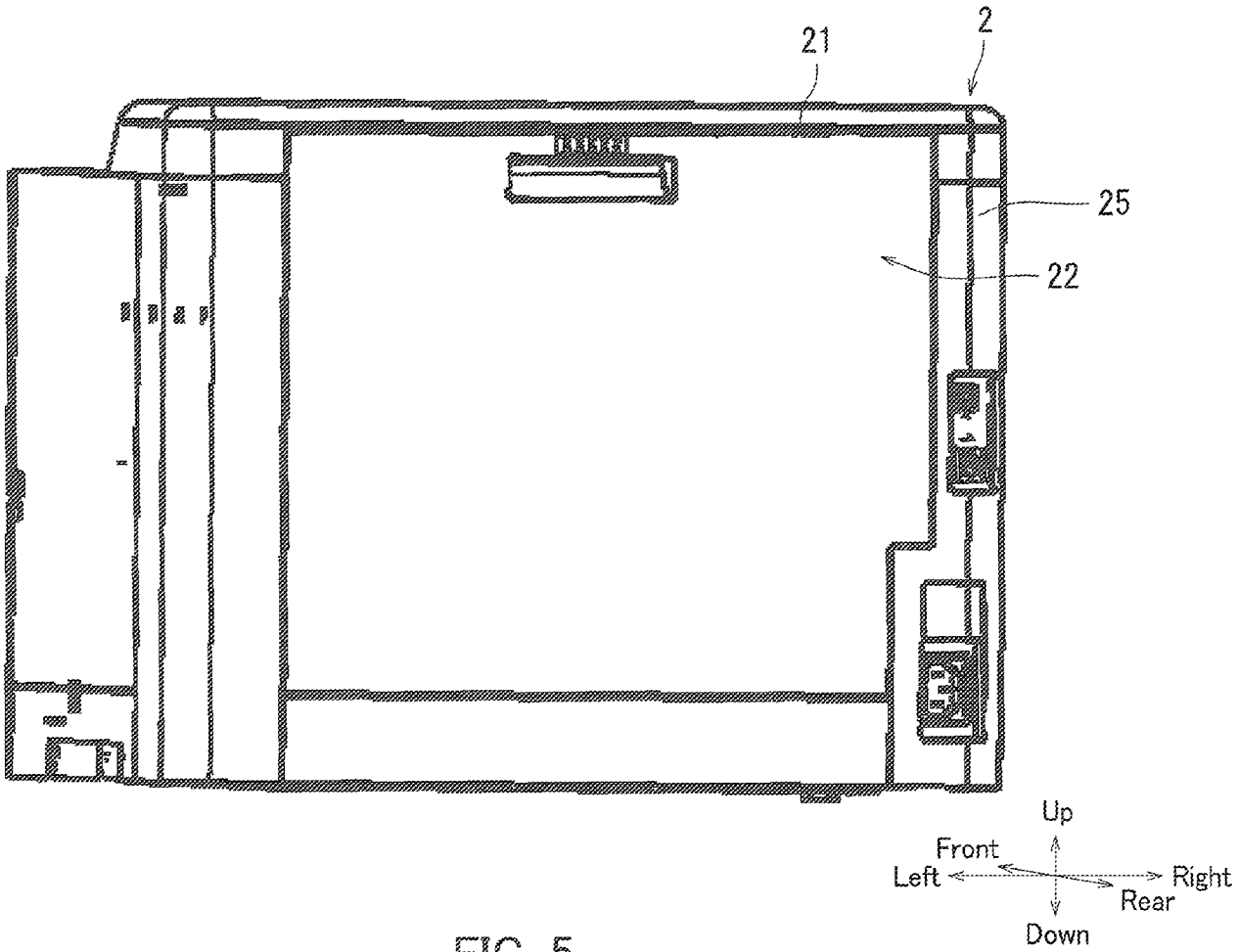
FIG. 5 is a perspective view illustrating the casing in a situation in which the rear cover is closed.

The configuration of the image forming apparatus 1 will be described in detail below with reference to FIGS. 2-5. FIG. 2 is a perspective view illustrating the casing 2 in a situation in which a rear cover 22 is open. FIG. 3 is an enlarged partial view of the casing 2 and illustrates the fixing section 6 in a situation in which a fixing section cover 65 is open. FIG. 4 is an enlarged partial view of FIG. 3. FIG. 5 is a perspective view illustrating the casing 2 in a situation in which the rear cover 22 is closed.

As illustrated in FIG. 2, the casing 2 has an opening 21 and includes the rear cover 22 (side cover) and a latching member 23.

The casing 2 is a box having a rectangular parallelepiped shape, for example. The casing 2 has a front surface 24, a rear surface 25, a left surface 26, and a right surface 27. Here, front, rear, left, and right of the image forming apparatus 1 correspond to the front surface 24, the rear surface 25, the left surface 26, and the right surface 27 of the casing 2, respectively.

The opening 21 exposes an interior of the casing 2. Through the opening 21, maintenance or inspection in the interior of the casing 2 (for example, jam clearance) is performed. The opening 21 has for example a rectangular shape and is located in the rear surface 25 of the casing 2.

The rear cover 22 opens and closes the opening 21. The rear cover 22 is disposed on the rear surface 25 of the casing 2 in an openable and closable manner. Specifically, the rear cover 22 has a rectangular shape substantially the same in shape and size as the opening 21. The rear cover 22 has a lower side part 22*a*. The lower side part 22*a* is supported by the casing 2 in a pivotal manner about a pivot axis B1 (third pivot axis). The pivot axis B1 extends in a left-right direction of the casing 2 (a width direction of the rear surface 25). In a situation in which the rear cover 22 is open, the rear cover 22 opens the opening 21 to expose the fixing section 6.

The fixing section 6 is disposed on a side of the opening 21 in an upper part of the casing 2. The fixing section 6 includes a fixing section main body 64 (fixing device main body) and the fixing section cover 65 (fixing device cover).

The fixing section cover 65 includes a fixing section cover main body 66 and a to-be-latched portion 67.

The fixing section main body 64 accommodates the pressure roller 61 and the fixing roller 62. The fixing section main body 64 is disposed in the casing 2 so as to extend in the left-right direction of the casing 2.

The fixing section cover 65 covers an upper surface and a rear surface of the fixing section main body 64 in an openable and closable manner. The fixing section cover 65 is disposed over the fixing section main body 64 in an openable and closable manner. The to-be-latched portion 67 is latched by the latching member 23 in a situation in which the fixing section cover 65 opens the fixing section main body 64. In the above configuration, a situation in which the fixing section cover 65 is unintentionally closed can be prevented. The to-be-latched portion 67 is located on a side end (for example, a right side end) of the fixing section cover 65.

The latching member 23 is disposed on a side end (for example, a right side end) of the rear surface of the fixing section main body 64 in the casing 2. That is, the latching member 23 is disposed at a location to latch the to-be-latched portion 67 in a situation in which the fixing section cover 65 is open.

In a situation in which the fixing section cover 65 is open as illustrated in FIG. 3, the top of the fixing section main body 64 is open. The fixing section main body 64 has an upper opening 68*e*. The upper opening 68*e* is an opening formed in a situation in which the top of the fixing section main body 64 is open. An interior of the fixing section main body 64 (for example, the pressure roller 61) is exposed through the upper opening 68*e*. In the above configuration, maintenance or inspection in the interior of the fixing section 6 (for example, jam clearance) is enabled. Furthermore, in a situation in which the fixing section cover 65 is open, the to-be-latched portion 67 is latched by the latching member 23 (see FIG. 4).

In a situation in which the rear cover 22 is closed as illustrated in FIG. 5, the rear cover 22 closes the opening 21. As a result, the fixing section 6 is not exposed.

Figure 6:
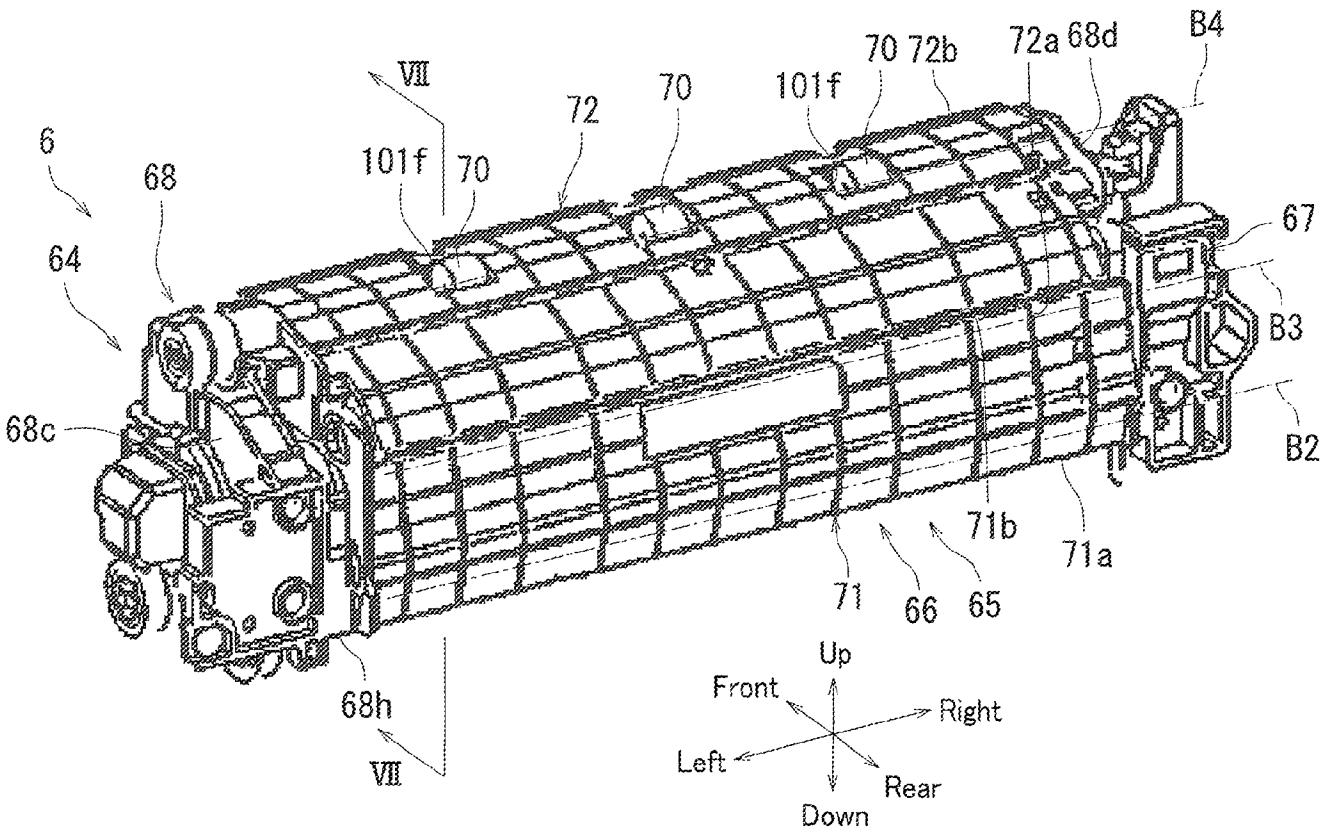
FIG. 6 is a perspective view illustrating the fixing section in a situation in which the fixing section cover is closed.

The fixing section 6 will be described next with reference to FIGS. 6-8. FIG. 6 is a perspective view illustrating the fixing section 6 in a situation in which the fixing section cover 65 is closed.

As illustrated in FIG. 6, the fixing section 6 includes the fixing section main body 64 and the fixing section cover 65.

The fixing section main body 64 includes a casing 68 in addition to the pressure roller 61 and the fixing roller 62. The casing 68 accommodates the pressure roller 61 and the fixing roller 62. The casing 68 is a box having a rectangular parallelepiped shape extending in a left-right direction of the image forming apparatus 1, for example. The fixing section cover 65 includes a plurality of (for example, three) ejection rollers 70 in addition to the fixing section cover main body 66 and the to-be-latched portion 67. The fixing section cover main body 66 includes a first cover portion 71 and a second cover portion 72.

The first cover portion 71 covers a rear surface of the casing 68 in an openable and closable manner. The first cover portion 71 has a lower end part 71*a* supported at a lower end part 68*h* in the rear surface of the casing 68 in a pivotal manner about a pivot axis B2 (first pivot axis). The pivot axis B2 extends in a longitudinal direction of the casing 68 (i.e., a left-right direction of the casing 68 or the width direction of the rear surface of the casing 68). The to-be-latched portion 67 is located on a side (for example, a right side) of the first cover portion 71.

The second cover portion 72 covers an upper surface of the casing 68 in an openable and closable manner. The second cover portion 72 has a rear end part 72*a* joined to an upper end part 71*b* of the first cover portion 71 in a pivotal manner about a pivot axis B3 (second pivot axis). The pivot axis B3 extends in the longitudinal direction of the casing 68. In the above configuration, the fixing section cover 65 is foldable at a joint part between the first cover portion 71 and the second cover portion 72.

The ejection rollers 70 eject the sheet P having passed through the fixing nip region N3 out of the fixing section 6. The ejection rollers 70 are located in the vicinity of a front edge 72*b* of the second cover portion 72. The ejection rollers 70 are spaced apart from each other along the front edge 72*b*. The ejection rollers 70 each have a rotational axis that coincides with a pivot axis B4 and extends in the longitudinal direction of the casing 68.

Figure 7:
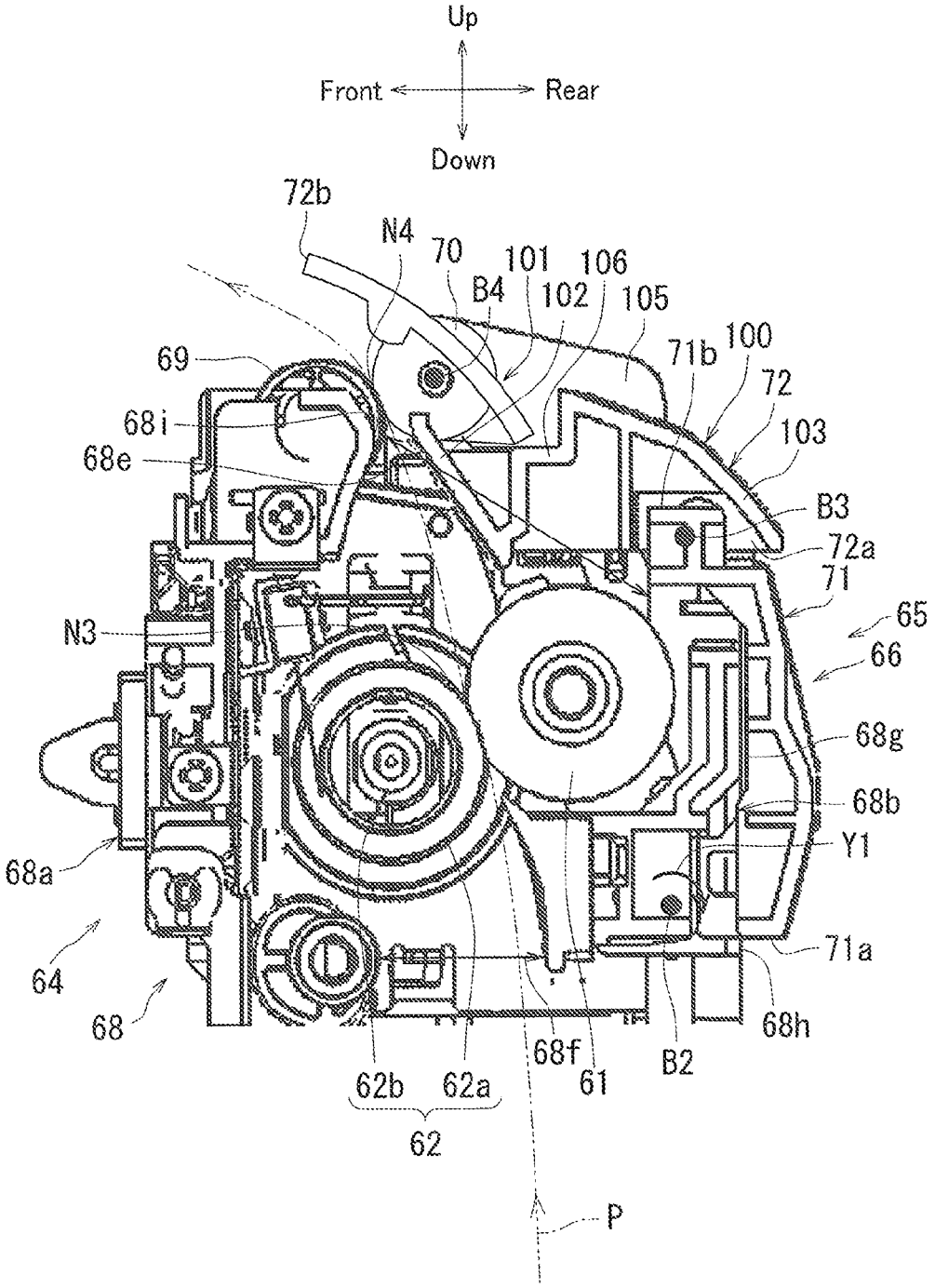
FIG. 7 is a cross sectional view taken along a line VII-VII in FIG. 6.

FIG. 7 is a cross sectional view taken along a line VII-VII in FIG. 6.

As illustrated in FIG. 7, the fixing section main body 64 further includes a plurality of (for example, three) ejection rollers 69 in addition to the pressure roller 61, the fixing roller 62, and the casing 68.

The casing 68 is a box having a rectangular parallelepiped shape as described above and includes a front wall 68*a*, a rear wall 68*b*, a left wall 68*c* (see FIG. 6), and a right wall 68*d* (see FIG. 6). Furthermore, the casing 68 has the upper opening 68*e* and a lower opening 68*f* indicated by respective solid bidirectional arrows in FIG. 7. The lower opening 68*f* is open in a situation in which the lower surface of the casing 68 is open. A sheet P is conveyed into the fixing section main body 64 through the lower opening 68*f*. Note that the upper opening 68*e* is located in an upper surface of the fixing section main body 64. A rear surface 68*g* of the rear wall 68*b* corresponds to the rear surface of the casing 68 and the rear surface of the fixing section main body 64.

The pressure roller 61 and the fixing roller 62 are disposed in the casing 68 in a rotatable manner. The fixing roller 62 is disposed for example in front of the pressure roller 61. The fixing roller 62 forms the fixing nip region N3 in cooperation with the pressure roller 61. The pressure roller 61 and the fixing roller 62 each have a rotational axis extending in the longitudinal direction of the casing 68. Respective opposite ends of the pressure roller 61 and the fixing roller 62 are supported by the left and right side walls 68*c* and 68*d* in a rotatable manner.

The fixing roller 62 includes a roller main body 62*a* and the heat source 62*b*. The roller main body 62*a* has a cylindrical shape. The heat source 62*b* is disposed in the roller main body 62*a*.

The ejection rollers 69 ejects the sheet P having passed through the fixing nip region N3 out of the fixing section 6 in cooperation with the ejection rollers 70. The ejection rollers 69 are disposed in the casing 68 in a rotatable manner. The ejection rollers 69 are located at a front edge 68*i* of the upper opening 68*e*. The ejection rollers 69 and the corresponding ejection rollers 70 form a nip region N4.

The fixing section 6 conveys the sheet P conveyed from the image forming section 5 into the fixing section main body 64 through the lower opening 68*f*. The conveyed sheet P passes through the fixing nip region N3. During the sheet P passing therethrough, the toner image formed on the sheet P is fixed to the sheet P through pressure by the pressure roller 61 and heat by the fixing roller 62. Subsequently, the sheet P having passed through the fixing nip region N3 passes through the nip region N4 and is ejected out of the fixing section 6 from between the front edge 68*i* and the front edge 72*b* by the ejection rollers 69 and the ejection rollers 70.

When the fixing section cover 65 of the fixing section 6 is turned in an arrow direction Y1 about the pivot axis B2, the fixing section cover 65 is open.

Figure 8:
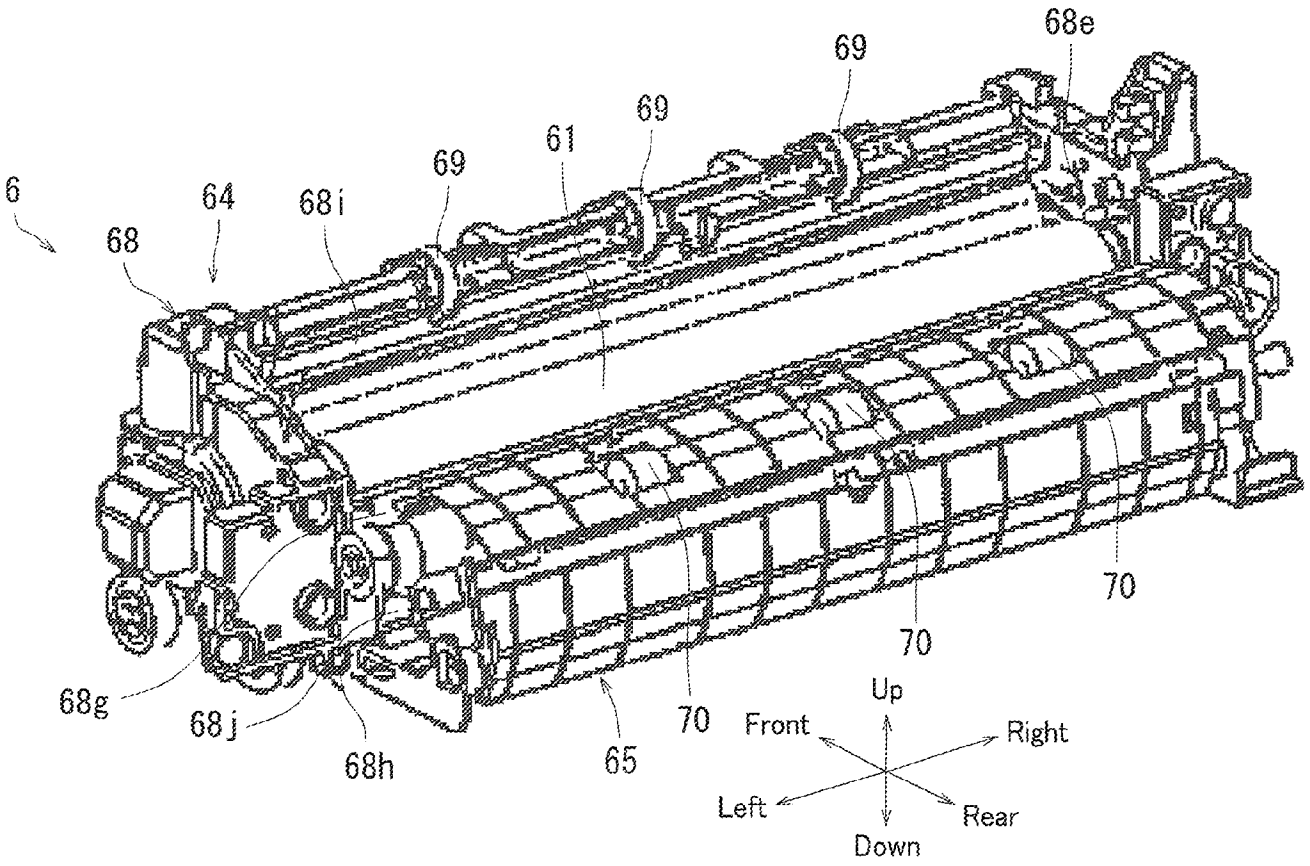
FIG. 8 is a perspective view illustrating the fixing section in a situation in which the fixing section cover is open.

FIG. 8 is a perspective view illustrating the fixing section 6 in a situation in which the fixing section cover 65 is open.

In a situation in which the fixing section cover 65 is open as illustrated in FIG. 8, the upper opening 68*e* and the rear surface 68*g* are open. The interior of the fixing section main body 64 (especially, the pressure roller 61) is exposed through the upper opening 68*e*.

The ejection rollers 69 are spaced apart from each other along the front edge 68*i* (i.e., in the longitudinal direction of the casing 68). The ejection rollers 69 have respective rotational axes that coincide with each other and that extend in the longitudinal direction of the casing 68.

The casing 68 further includes engaging portions 68*j*. The engaging portions 68*j* support the fixing section cover 65 in a pivotal manner about the pivot axis B2. The respective engaging portions 68*j* are disposed on right and left sides of the lower end part 68*h* in the rear surface 68*g* of the casing 68.

Figure 9:
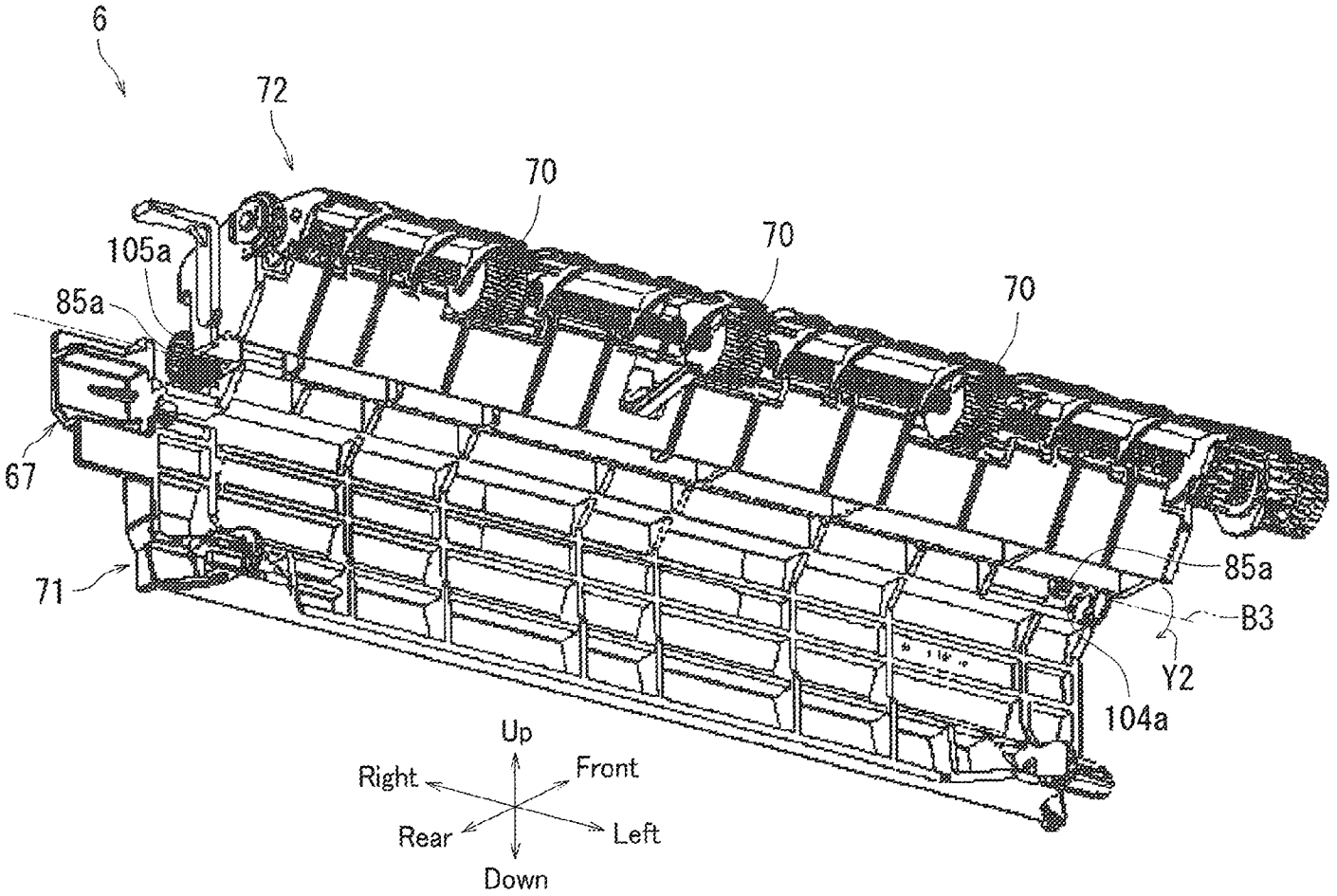
FIG. 9 is a perspective view illustrating a situation in which the fixing section cover is unfolded.
Figure 10:
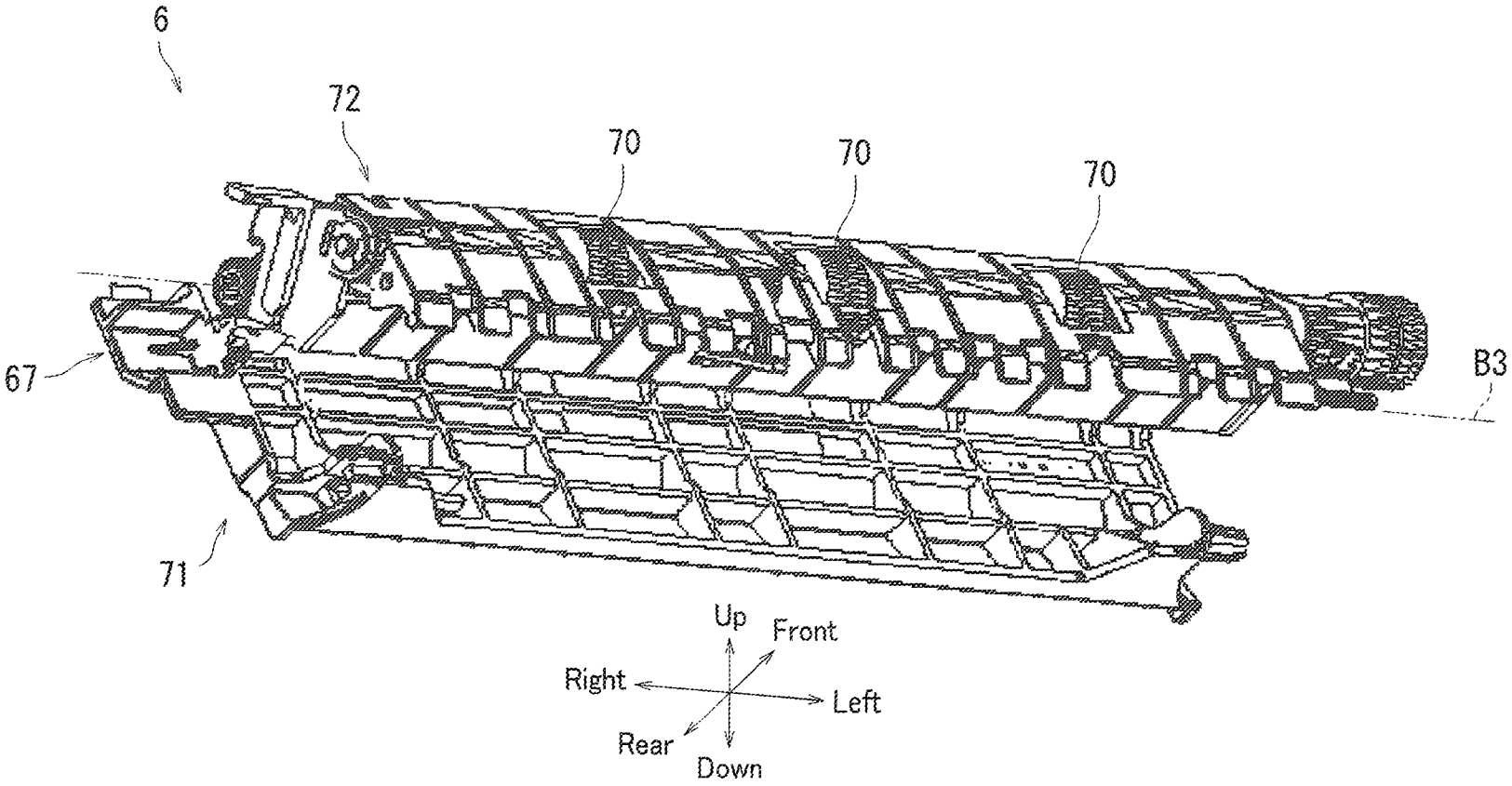
FIG. 10 is a perspective view illustrating a situation in which the fixing section cover is folded.
Figure 11:
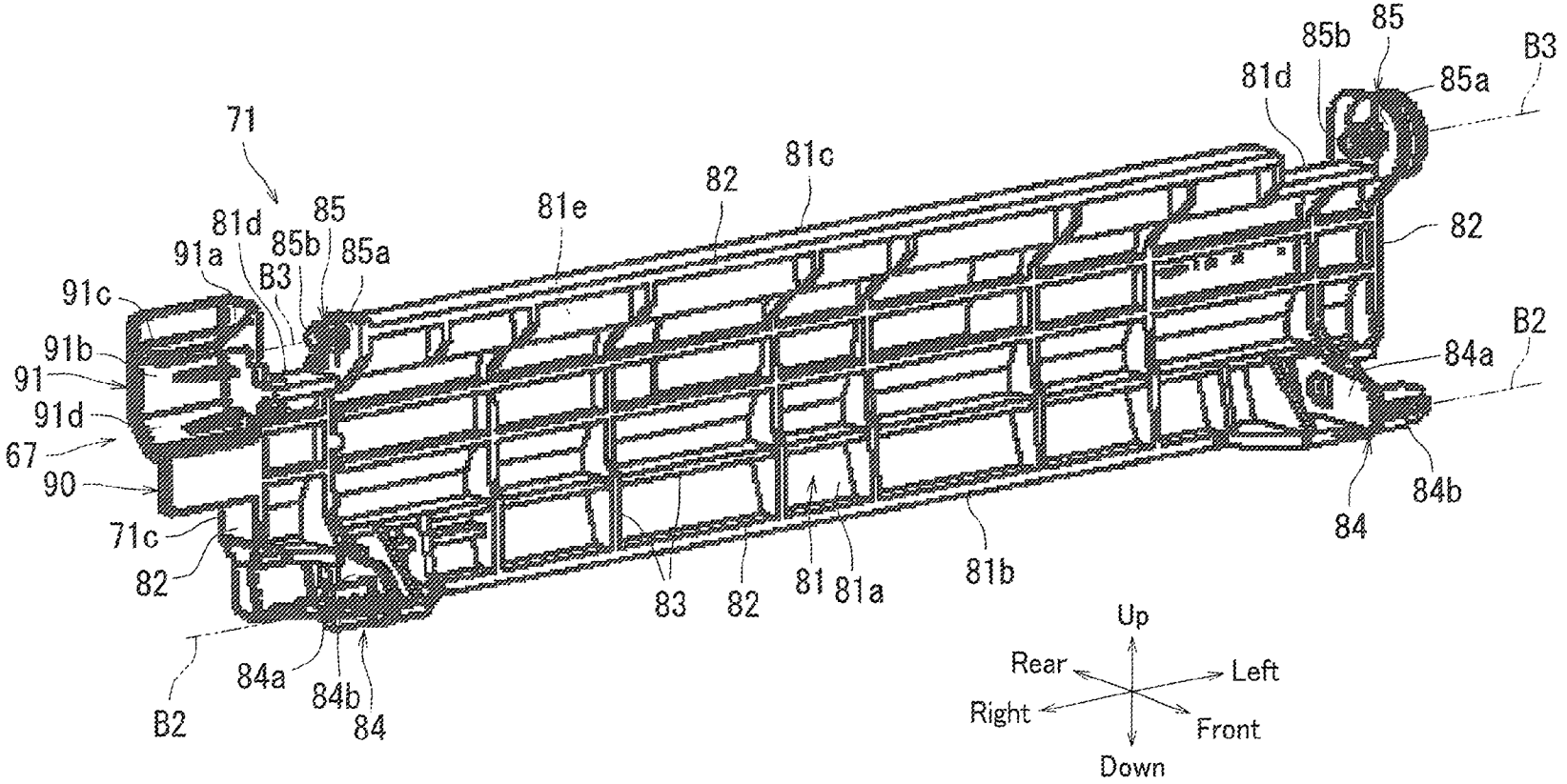
FIG. 11 is a perspective view illustrating a first cover portion and a to-be-latched portion.

The fixing section cover 65 will be described next in detail with reference to FIGS. 9-12. FIG. 9 is a perspective view illustrating a situation in which the fixing section cover 65 is unfolded. FIG. 10 is a perspective view illustrating a situation in which the fixing section cover 65 is folded. FIG. 11 is a perspective view illustrating the first cover portion 71 and the to-be-latched portion 67.

As illustrated in FIG. 9, in the fixing section 6, the second cover portion 72 is pivotal about the pivot axis B3 in an arrow direction Y2 relative to the first cover portion 71. When the second cover portion 72 is turned in an arrow direction Y2 about the pivot axis B3 relative to the first cover portion 71, the second cover portion 72 is folded on the first cover portion 71 as illustrated in FIG. 10. In the above configuration, a situation in which the fixing section cover 65 hinders maintenance or inspection of the fixing section 6 can be prevented because the fixing section cover 65 is folded in such maintenance or inspection.

As illustrated in FIG. 11, the first cover portion 71 includes a plate-shaped portion 81, a frame 82, a plurality of ribs 83, a pair of to-be-engaged portions 84, a pair of engaging portions 85, a first urging member (not illustrated), and a second urging member (not illustrated).

The plate-shaped portion 81 covers the rear surface 68*g* of the fixing section main body 64 in an openable and closable manner. The plate-shaped portion 81 has a rectangular plate shape extending in the left-right direction of the image forming apparatus 1. The plate-shaped portion 81 has an outer surface 81*e* that functions as a guide of the reversed sheet conveyance path 9. The frame 82 reinforces the plate-shaped portion 81. The frame 82 stands on the periphery of an inner surface (i.e., front surface) 81*a* of the plate-shaped portion 81. The ribs 83 reinforce the plate-shaped portion 81. The ribs 83 stand in a lattice formation on the inner surface 81*a* of the plate-shaped portion 81. A lower end part 81*b* of the plate-shaped portion 81 constitutes the lower end part 71*a* of the first cover portion 71. An upper end part 81*c* of the plate-shaped portion 81 constitutes the upper end part 71*b* of the first cover portion 71.

The respective to-be-engaged portions 84 is engaged by the engaging portions 68*j* of the fixing section main body 64. In the above configuration, the first cover portion 71 is supported by the fixing section main body 64 in a pivotal manner about the pivot axis B2. The respective to-be-engaged portions 84 are located on the right and left sides of the lower end part 81*b* in the inner surface 81*a* of the plate-shaped portion 81.

The to-be-engaged portions 84 each include a support part 84*a* and a rotational shaft 84*b*. The support part 84*a* supports the rotational shaft 84*b*. The support part 84*a* has a plate shape, for example. The support part 84*a* stands on the inner surface 81*a* of the plate-shaped portion 81. The support part 84*a* protrudes from the inner surface 81*a* such that inner and outer main surfaces of the support part 84*a* face in the left-right direction of the image forming apparatus 1. The rotational shafts 84*b* each are supported at a corresponding one of the engaging portion 68*j* of the fixing section main body 64 in a pivotal manner. The rotational shafts 84*b* stand on the outer main surfaces of the respective support part 84*a*. The rotational shaft 84*b* has a central axis that coincides with the pivot axis B2.

The pair of engaging portions 85 engages the second cover portion 72. In the above configuration, the second cover portion 72 is supported by the first cover portion 71 in a pivotal manner about the pivot axis B3. The respective engaging portions 85 are located on the right and left sides of the upper end part 81*c* of the plate-shaped portion 81.

The engaging portions 85 each include a support part 85*a* and a rotational shaft 85*b* (i.e., right and left rotational shafts 85*b*). The support part 85*a* supports the rotational shaft 85*b*. The support part 85*a* has a plate shape, for example. The plate-shaped portion 81 has concave notches 81*d*. The respective notches 81*d* are located in right and left side parts of the upper end part 81*c* of the plate-shaped portion 81. The support part 85*a* is located on a side (for example, a left side) in a corresponding one of the notches 81*d*. The support part 85*a* is perpendicular to the inner surface 81*a* of the plate-shaped portion 81 and protrudes from the inner surface 81*a*. The rotational shaft 85*b* is supported at the second cover portion 72 in a pivotal manner. The rotational shaft 85*b* is disposed on the support part 85*a*. The rotational shaft 85*b* protrudes inward of the notches 81*d* (that is, rightward of the fixing section 6). The rotational shaft 85*b* has a central axis that coincides with the pivot axis B3.

The first urging member urges the first cover portion 71 in a closing direction. The first urging member may be for example a torsion spring. In a configuration in which the first urging member is a torsion spring, the first urging member is wound around the rotational shaft 84*b*, for example. One end of the first urging member is secured to the first cover portion 71, and the other end thereof is secured to the fixing section main body 64.

The second urging member urges the second cover portion 72 in a direction in which the second cover portion 72 is folded on the first cover portion 71. The second urging member may be for example a torsion spring. In a configuration in which the second urging member is a torsion spring, the second urging member is wound around the rotational shaft 85*b*, for example. One end of the second urging member is secured to the first cover portion 71, and the other end thereof is secured to the second cover portion 72.

The to-be-latched portion 67 is latched by the latching member 23 in a situation in which the fixing section cover 65 opens the fixing section main body 64. Furthermore, the to-be-latched portion 67 is pushed by the rear cover 22 in a situation in which the rear cover 22 closes the casing 2. In the above configuration, the to-be-latched portion 67 pushes the fixing section cover 65 in a closing direction. The to-be-latched portion 67 is disposed at one end part 71*c* (for example, right end) of the first cover portion 71 in the longitudinal direction. The end part 71*c* corresponds to an outer surface of a right frame part of the frame 82. The to-be-latched portion 67 protrudes sideways (for example, rightward) from the first cover portion 71.

The to-be-latched portion 67 includes a to-be-latched part 90 and a to-be-pushed part 91.

The to-be-latched part 90 is latched by the latching member 23. The to-be-latched part 90 may has a rectangular plate shape, for example. The to-be-latched part 90 is located at the end part 71*c* of the first cover portion 71. The to-be-latched part 90 protrudes sideways (that is, rightward) from the first cover portion 71 and is substantially parallel to the plate-shaped portion 81 of the first cover portion 71.

The to-be-pushed part 91 is pushed by the rear cover 22 in a situation in which the rear cover 22 closes the casing 2. The to-be-pushed part 91 includes a support part 91*a*, a to-be-pushed main part 91*b*, a reinforcing wall 91*c*, and a joint part 91*d*.

The support part 91*a* supports the to-be-pushed main part 91*b*. The support part 91*a* has a rectangular plate shape extending in for example a vertical direction. The support part 91*a* is located at the end part 71*c* of the first cover portion 71. The support part 91*a* is parallel to the end part 71*c* and protrudes upward from the end part 71*c*.

The to-be-pushed main part 91*b* has a rectangular plate shape, for example. The to-be-pushed main part 91*b* is located on the support part 91*a*. The to-be-pushed main part 91*b* protrudes sideways (for example, rightward) from the first cover portion 71 and is substantially parallel to the to-be-latched part 90. The to-be-pushed main body 91*b* is located above the to-be-latched part 90 in the rear of the to-be-latched part 90.

The reinforcing wall 91*c* reinforces the to-be-pushed main part 91*b*. The reinforcing wall 91*c* is located in a corner of a boundary between the to-be-pushed main part 91*b* and the support part 91*a*. The joint part 91*d* may has a rectangular plate shape, for example. The joint part 91*d* stands on the support part 91*a*. The joint part 91*d* joins a lower end of the to-be-pushed part 91*b* and an upper end of the to-be-latched part 90. In the above configuration, the to-be-latched part 90 is integral with the to-be-pushed part 91 to increase strength of the to-be-latched portion 67.

Figure 12:
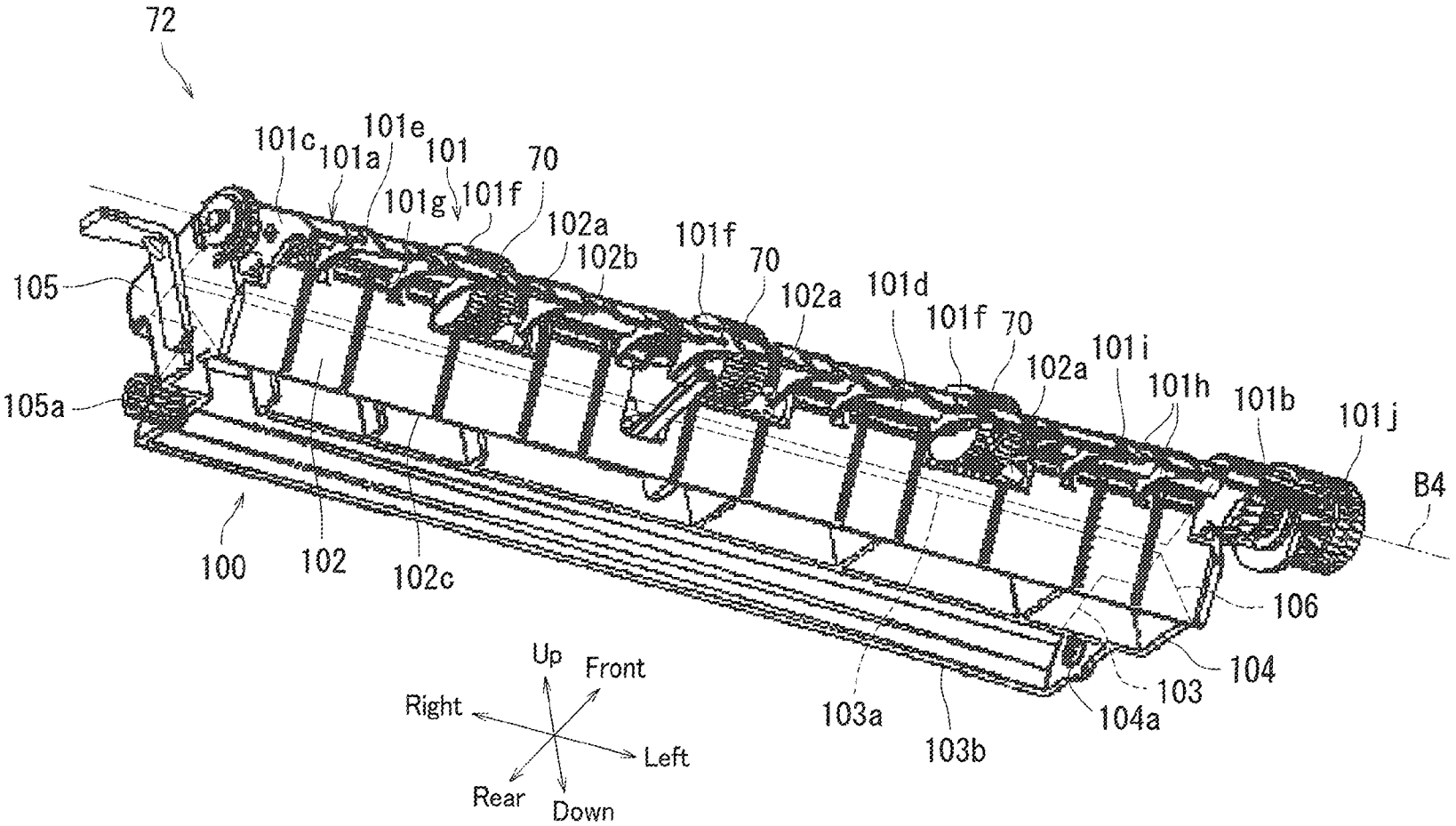
FIG. 12 is a perspective view illustrating a second cover portion.

FIG. 12 is a perspective view illustrating the second cover portion 72.

As illustrated in FIG. 12, the second cover portion 72 includes a double-side guide section 100 and a reverse side guide section 101.

The double-side guide section 100 constitutes a part of the sheet conveyance path 8. The double-side guide section 100 also constitutes a part of the reversed sheet conveyance path 9. The double-side guide section 100 is a box having a rectangular parallelepiped shape and includes a front wall 102, a rear wall 103, a left wall 104, a right wall 105, and a joint wall 106.

The front wall 102 functions as a guide of the sheet conveyance path 8. The front wall 102 guides the sheet P having passed through the fixing nip region N3 to the nip region N4 (see FIG. 7). The front wall 102 has a rectangular plate shape extending in the left-right direction of the image forming apparatus 1. The front wall 102 has a plurality of (for example, three) notches 102*a*. The notches 102*a* each are in a concave shape and each receive a corresponding one of the ejection rollers 70. The notches 102*a* are located in an upper edge 102*b* of the front wall 102.

The rear wall 103 functions as a guide of the reversed sheet conveyance path 9. The rear wall 103 has a rectangular plate shape extending in the left-right direction of the image forming apparatus 1. The rear wall 103 has an upper end part 103*a* and a lower end part 103*b*. The rear wall 103 inclines rearward from the upper end part 103*a* to the lower end part 103*b* in an arcuate fashion. The lower end part 103*b* of the rear wall 103 constitutes the rear end part 72*a* of the second cover portion 72.

The left wall 104 has a lower through hole 104*a*. The lower through hole 104*a* receives the left rotational shaft 85*b* of the first cover portion 71 in a pivotal manner. The lower through hole 104*a* is located on a side of the rear wall 103 in a lower part of the left wall 104. The right wall 105 has a lower protrusion 105*a*. The lower protrusion 105*a* has a through hole that receives the right rotational shaft 85*b* of the first cover portion 71 in a pivotal manner. The lower protrusion 105*a* is located on a side of the rear wall 103 in a lower part of the right wall 105. The lower protrusion 105*a* has for example a cylindrical shape and protrudes outward from the right wall 105. The lower through hole 104*a* receives the left rotational shaft 85*b*. The through hole of the lower protrusion 105*a* receives the right rotational shaft 85*b*. In the above configuration, the second cover portion 72 is joined to the first cover portion 71 in a pivotal manner about the pivot axis B3.

The right and left walls 105 and 104 each have an upper through hole (not illustrated). The upper through hole is located on a side of the front wall 102 in an upper part of each of the right and left walls 105 and 104. The upper through hole pivotally supports the reverse side guide section 101.

The joint wall 106 has a rectangular plate shape extending in the left-right direction of the image forming apparatus 1. The joint wall 106 joins a lower end part 102*c* of the front wall 102 and the upper end part 103*a* of the rear wall 103. Right and left end parts of the joint wall 106 are connected to the left wall 104 and the right wall 105, respectively.

The reverse side guide section 101 functions as a guide of the reversed sheet conveyance path 9. Furthermore, the reverse side guide section 101 constitutes the diverging point T1 between the sheet conveyance path 8 and the reversed sheet conveyance path 9 (see FIG. 1). The reverse side guide section 101 switches an inlet of the reversed sheet conveyance path 9 between a closed state and an open state. The reverse side guide section 101 is disposed such as to cover the top of the double-side guide section 100.

The reverse side guide section 101 includes a plate-shaped part 101*a*, right and left support parts 101*b* and 101*c*, a rotational shaft 101*d*, a drive power input section 101*j*, and a plurality of ribs 101*h*.

The plate-shaped part 101*a* has a rectangular plate shape extending in the left-right direction of the image forming apparatus 1. The plate-shaped part 101*a* has an outer surface (i.e., upper surface) 101*e* that functions as a guide of the reversed sheet conveyance path 9. The plate-shaped part 101*a* has a front edge part 101*i* that constitutes the front edge 72*b* of the second cover portion 72.

The plate-shaped part 101*a* has a plurality of (for example, three) openings 101*f*. The openings 101*f* are spaced apart from each other in a longitudinal direction (i.e., left-right direction) of the plate-shaped part 101*a*. The openings 101*f* each receive a corresponding one of the ejection rollers 70.

The right and left support parts 101*c* and 101*b* support the rotational shaft 101*d* in a rotatable manner. The right and left support parts 101*c* and 101*b* stand on the right and left ends of the inner surface (i.e., lower surface) of the plate-shaped part 101*a*, respectively. The right and left support parts 101*c* and 101*b* each have a through hole (not illustrated). The through hole receives a corresponding one of opposite end parts of the rotational shaft 101*d* in a rotatable manner. The rotational shaft 101*d* has a central axis that coincides with the pivot axis B4. The ejection rollers 70 are secured to the rotational shaft 101*d* in a concentric manner.

The ejection rollers 70 each correspond to one of the openings 101*f*. The ejection rollers 70 each protrude from a corresponding one of the openings 101*f* through the outer surface 101*e* of the plate-shaped part 101*a*. The ejection rollers 70 each correspond to one of the notches 102*a* in the double-side guide section 100. The ejection rollers 70 each protrude frontward of the front wall 102 through a corresponding one of the notches 102*a*.

The respective opposite end parts of the rotational shaft 101*d* are inserted in the right and left upper through holes of the double-side guide section 100. In the above configuration, the reverse side guide section 101 is pivotal about the pivot axis B4 relative to the double-side guide section 100. In the pivotal configuration as above, the front edge part 101*i* of the reverse side guide section 101 is pivotal in a vertical direction. The front edge part 101*i* constitutes the diverging point T1. When the front edge part 101*i* is turned to face downward, the inlet of the reversed sheet conveyance path 9 is open. When the front edge part 101*i* is turned to face upward, the inlet of the reversed sheet conveyance path 9 is closed.

The drive power input section 101*j* receives drive power for rotating the rotational shaft 101*d*. The drive power input section 101*j* is secured at one of the opposite end parts of the rotational shaft 101*d*.

The ribs 10*h* reinforce the plate-shaped part 101*a*. The ribs 101*h* stand in a lattice formation on the inner surface 101*g* of the plate-shaped part 101*a*.

Figure 13:
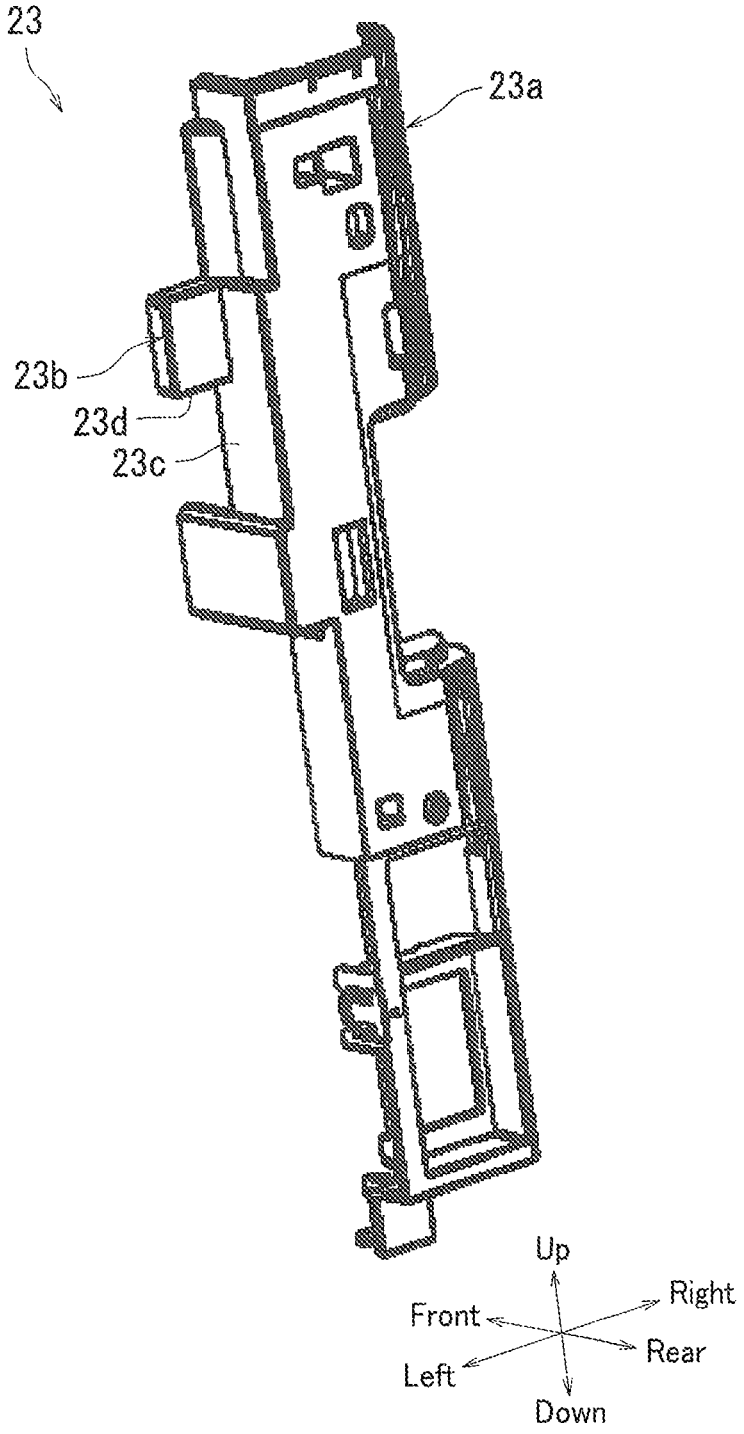
FIG. 13 is a perspective view illustrating a latching member.

The latching member 23 will be described in detail with reference to FIG. 13. FIG. 13 is a perspective view illustrating the latching member 23.

As illustrated in FIG. 13, the latching member 23 includes the support portion 23*a* and the latching portion 23*b*. The support portion 23*a* supports the latching portion 23*b*. The support portion 23*a* also functions as a covering member that covers a part of the interior of the casing 2. The support portion 23*a* has a rectangular plate shape extending in for example a vertical direction. The support portion 23*a* is located on a side end (for example, right side end) of the rear surface 68*g* of the fixing section 6.

The latching portion 23*b* latches the to-be-latched part 90 of the to-be-latched portion 67 in a situation in which the fixing section cover 65 opens the fixing section main body 64. The latching portion 23*b* may have a rectangular plate shape, for example. The latching portion 23*b* is located at a left end part 23*c* of the support portion 23*a*. The latching portion 23*b* protrudes leftward from the left end part 23*c* of the support portion 23*a*. In the above configuration, the latching portion 23*b* is located in the rear of (specifically, directly behind and below) the to-be-latched portion 67 in a situation in which the fixing section cover 65 closes the fixing section main body 64. Furthermore, the latching portion 23*b* is located on the support portion 23*a* with its respective opposite main surfaces facing frontward and backward.

Figure 14:
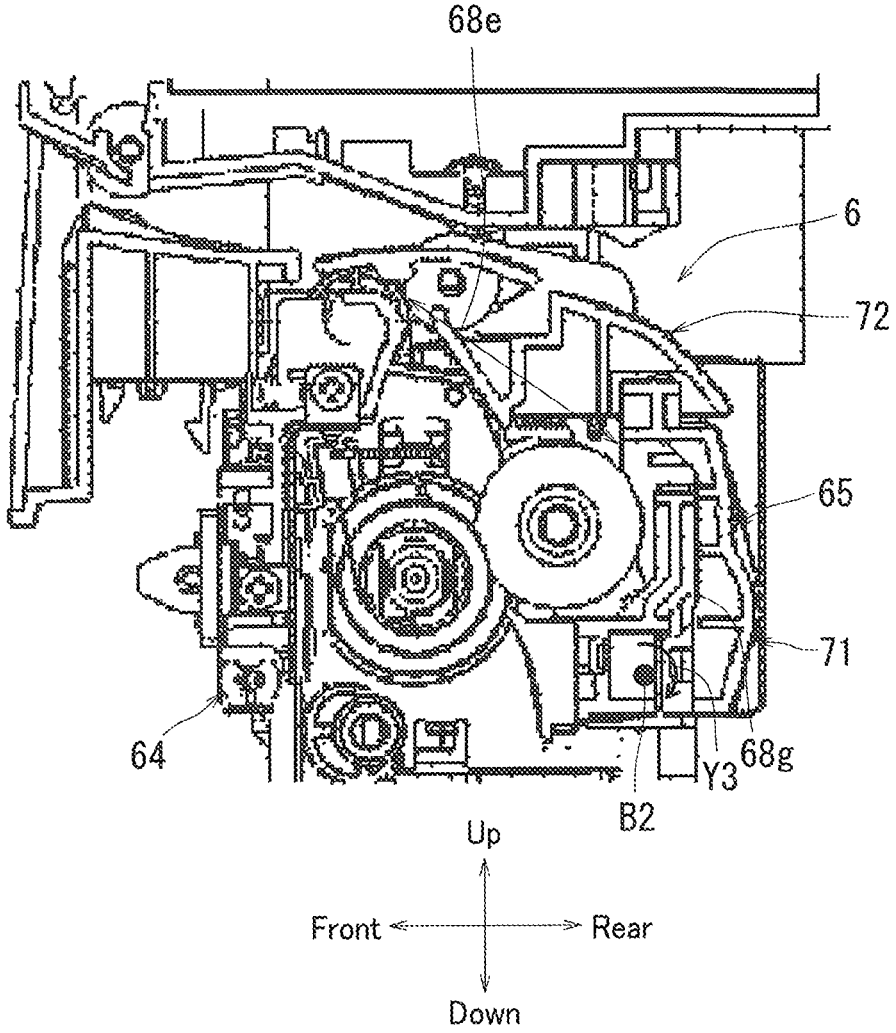
FIG. 14 is a cross sectional view illustrating the fixing section as viewed from a side in a situation in which the fixing section cover is closed.
Figure 15:
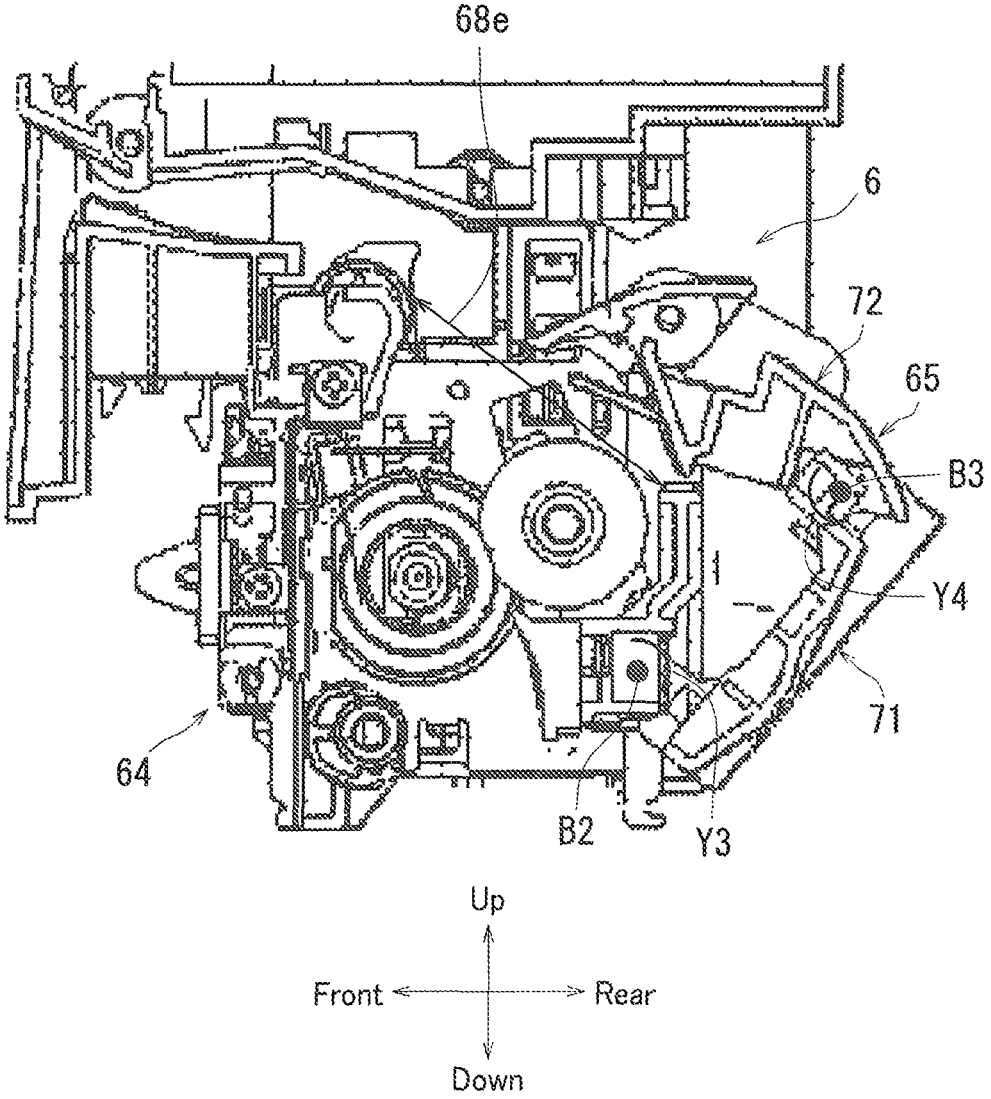
FIG. 15 is a cross sectional view illustrating the fixing section as viewed from the side in a situation in which the fixing section cover is opened partway.
Figure 16:
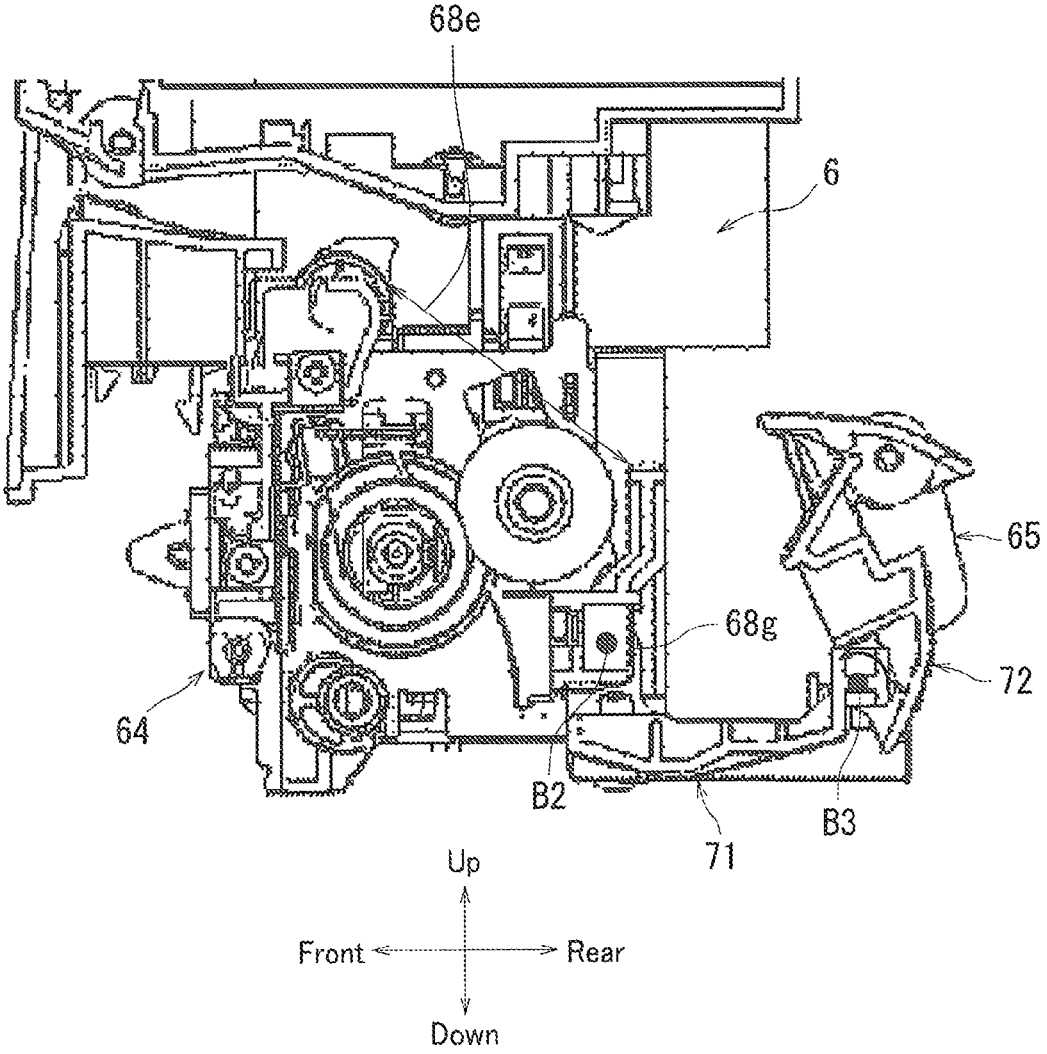
FIG. 16 is a cross sectional view illustrating the fixing section as viewed from the side in a situation in which the fixing section cover is fully open.

Operation to open the fixing section cover 65 will be described next with reference to FIGS. 14-17. FIG. 14 is a cross sectional view of the fixing section 6 as viewed from a side in a situation in which the fixing section cover 65 is closed. FIG. 15 is a cross sectional view of the fixing section 6 as viewed from the side in a situation in which the fixing section cover 65 is opened partway. FIG. 16 is a cross sectional view of the fixing section 6 as viewed from the side in a situation in which the fixing section cover 65 is fully opened.

In a situation in which the fixing section cover 65 is closed as illustrated in FIG. 14, the fixing section cover 65 closes the upper opening 68*e* and the rear surface 68*g* of the fixing section main body 64. In opening of the fixing section cover 65, the fixing section cover 65 is turned about the pivot axis B2 in an arrow direction Y3.

In a situation in which the fixing section cover 65 is opened partway relative to the fixing section main body 64 as illustrated in FIG. 15, the first cover portion 71 is turned about the pivot axis B2 in the arrow direction Y3. In addition, the second urging member turns the second cover portion 72 about the pivot axis B3 in an arrow direction Y4. As a result, the second cover portion 72 retreats while sliding over the upper opening 68*e* of the fixing section main body 64 to open the upper opening 68*e*. That is, the second cover portion 72 does not turn in a manner of drawing an arc in a space above the fixing section main body 64. In the above configuration, it is unnecessary to secure space for opening and closing the second cover portion 72 above the fixing section main body 64. As such, the image forming apparatus 1 can be reduced in size.

In a situation in which the first cover portion 71 is turned about the pivot axis B2 by a specific angel (for example, 90 degrees) in the arrow direction Y3 as illustrated in FIG. 16, the fixing section cover 65 fully opens the fixing section main body 64.

Figure 17:
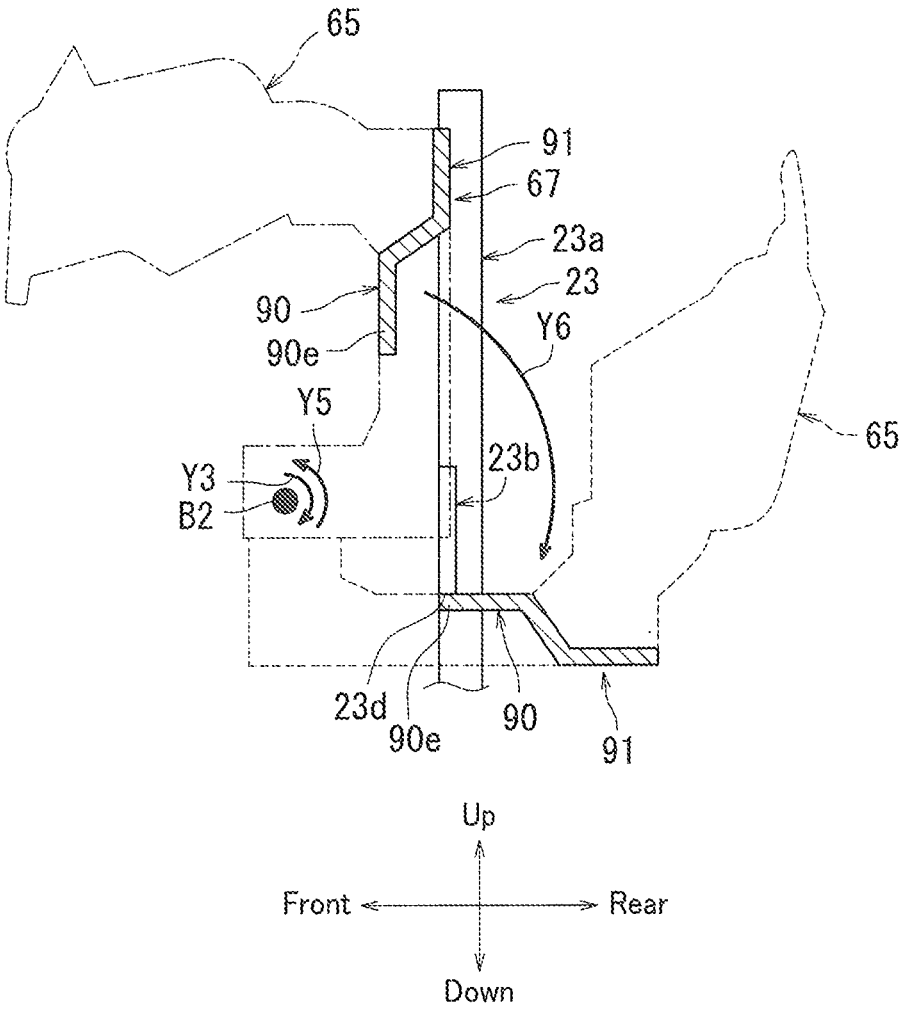
FIG. 17 is a side view illustrating operation of the to-be-latched portion in association with operation to open the fixing section cover.

FIG. 17 is a side view illustrating operation of the to-be-latched portion 67 in association with operation to open the fixing section cover 65.

As illustrated in FIG. 17, the fixing section cover 65 is turned about the pivot axis B2 from a closed position indicated by a dashed line to a full open position indicated by a broken line. In turning of the fixing section cover 65 as above, the to-be-latched portion 67 of the fixing section cover 65 turns about the pivot axis B2 in an arrow direction Y6. In turning as above, the to-be-latched portion 67 travels from above to below in the rear of the latching portion 23*b* of the latching member 23.

In a situation in which the fixing section cover 65 is turned to the full open position, a lower end part 90*e* of the to-be-latched part 90 enters under a lower end part 23*d* of the latching portion 23*b*. As a result, the to-be-latched part 90 is latched by the latching portion 23*b*. In the above configuration, the fixing section cover 65 is prevented from turning in the closing direction (that is, an arrow direction Y5). As a result, it is unnecessary to press the fixing section cover 65 with a hand in jam clearance so that the fixing section cover 65 is not closed, thereby improving workability in jam clearance.

Note that in the above configuration in which only the lower end part 90*e* of the to-be-latched part 90 enters under the latching portion 23*b*, latch between the to-be-latched part 90 and the latching portion 23*b* is released by turning the fixing section cover 65 in the arrow direction Y5 with force of a specific strength.

Figure 18:
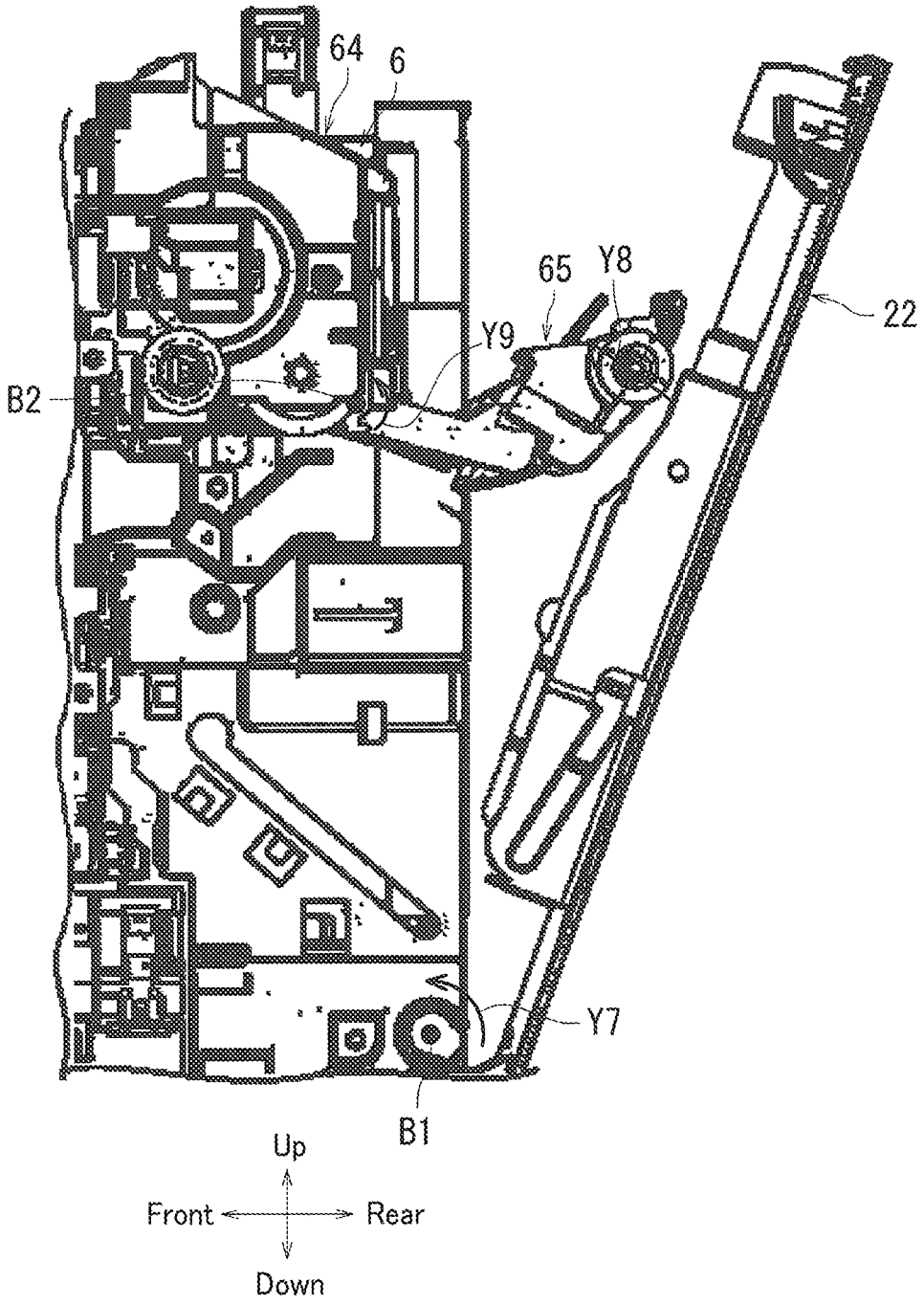
FIG. 18 illustrates the casing as viewed from a side in a situation in which the rear cover and the fixing section cover are open.

Operation to close the fixing section cover 65 will be described next with reference to FIG. 18. FIG. 18 illustrates the casing 2 as viewed from a side in a situation in which the rear cover 22 and the fixing section cover 65 are open.

In closing of the fixing section cover 65, the rear cover 22 is turned about the pivot axis B1 in an arrow direction Y7 to close the rear cover 22, as illustrated in FIG. 18. When the rear cover 22 is closed partway, the rear cover 22 pushes the fixing section cover 65 in an obliquely upward direction Y8. Through pushing as above, the to-be-latched part 90 of the to-be-latched portion 67 is released from the latching portion 23*b* of the latching member 23. That is, latch between the to-be-latched part 90 and the latching portion 23*b* is released. In addition, the rear cover 22 turns the fixing section cover 65 about the pivot axis B2 in an arrow direction Y9. The arrow direction Y9 is a direction in which the fixing section cover 65 is closed.

When the rear cover 22 is closed, the fixing section cover 65 is closed. That is, the fixing section cover 65 is closed by the rear cover 22 in association with the operation to close the rear cover 22. In the above configuration, the fixing section cover 65 can be easily closed.

The embodiment of the present disclosure has been described so far with reference to the drawings (FIGS. 1-18). However, the present disclosure is not limited to the specific embodiment described above and can be practiced in various ways within the scope not departing from the essence of the present disclosure. The drawings are schematic illustrations that emphasize elements of configuration in order to facilitate understanding thereof. Therefore, properties of each of the elements in the drawings, such as thickness, length, and number, may differ from actual properties of the elements for the sake of illustration convenience. The properties of each of the elements, such as material, shape, and dimension thereof described in the above embodiment are mere example and not limited specifically and can be altered in various ways to the extent that there is not substantial deviation from the effects of the present disclosure.

What is claimed is:

1. An image forming apparatus comprising:

an apparatus main body;

a fixing device disposed in the apparatus main body; and a latching member disposed at the apparatus main body, wherein the fixing device includes:

a fixing device main body configured to fix a toner image formed on a recording medium to the recording medium; and a fixing device cover disposed over the fixing device main body in an openable and closable manner, the fixing device cover includes:

a fixing device cover main body disposed over the fixing device main body in an openable and closable manner; and a to-be-latched portion disposed on the fixing device cover main body, in a situation in which the fixing device cover is open, the to-be-latched portion is latched by the latching member, the fixing device cover includes:

a first cover portion that opens and closes a rear surface of the fixing device main body; and a second cover portion that opens and closes an upper surface of the fixing device main body, the first cover portion has a lower end part supported at a lower end part of the rear surface of the fixing device main body in a pivotal manner about a first pivot axis that extends in a width direction of the rear surface of the fixing device main body, the second cover portion has a rear end part joined to an upper end part of the first cover portion in a pivotal manner about a second pivot axis that extends in the width direction of the rear surface of the fixing device main body, and the to-be-latched portion of the fixing device cover is located at the first cover portion.

2. The image forming apparatus according to claim 1, wherein the to-be-latched portion of the fixing device cover is located at a side end part of the fixing device cover main body, the latching member is located on a side end of the rear surface of the fixing device main body, the latching member includes an latching portion protruding in rear of the to-be-latched portion, and in a situation in which the fixing device cover is open, the to-be-latched portion enters under the latching portion to be latched by the latching portion.

3. The image forming apparatus according to claim 2, wherein when the fixing device cover is open, the to-be-latched portion of the fixing device cover travels in rear of the latching portion of the latching member and enters under the latching portion.

4. The image forming apparatus according to claim 1, wherein the to-be-latched portion of the fixing device cover has an end part that is latched by the latching member.

5. An image forming apparatus comprising:

an apparatus main body;

a fixing device disposed in the apparatus main body; and a latching member disposed at the apparatus main body, wherein the fixing device includes:

a fixing device main body configured to fix a toner image formed on a recording medium to the recording medium; and a fixing device cover disposed over the fixing device main body in an openable and closable manner, the fixing device cover includes:

a fixing device cover main body disposed over the fixing device main body in an openable and closable manner; and a to-be-latched portion disposed on the fixing device cover main body, in a situation in which the fixing device cover is open, the to-be-latched portion is latched by the latching member, the apparatus main body includes a side cover openable and closable relative to a side surface of the apparatus main body, the side cover has a lower end part supported at a lower end part of the side surface of the apparatus main body in a pivotal manner about a third pivot axis that extends in a width direction of the side surface, the fixing device cover is exposed in a situation in which the side cover is open, and when the side cover is closed, the fixing device cover is pushed by the side cover to be closed.

6. The image forming apparatus according to claim 5, wherein the to-be-latched portion of the fixing device includes a to-be-latched part latched by the latching member and a to-be-push portion pushed by the side cover of the apparatus main body, and the to-be-latched part is integral with the to-be-pushed part.

7. The image forming apparatus according to claim 1, wherein the latching member includes an latching portion that latches the to-be-latched portion of the fixing device and a support portion that supports the latching portion, and the support portion functions as a covering member that covers a part of an interior of the apparatus main body.

* * * * *